US005115588A

United States Patent [19]

Bronsart et al.

[11] Patent Number: 5,115,588

[45] Date of Patent: May 26, 1992

[54] TRIGGER MECHANISM FOR FIREARMS

[76] Inventors: Gene Bronsart; Linda Bronsart, both of 2361 Clarke Pl., Lake Havasu City, Ariz. 86403

[21] Appl. No.: 509,020

[22] Filed: Apr. 12, 1990

[51] Int. Cl.[5] ..... F41A 19/10

[52] U.S. Cl. ..... 42/69.02; 42/69.01

[58] Field of Search ..... 42/69.01, 69.02, 7, 42/41, 42.01

[56] References Cited

U.S. PATENT DOCUMENTS

| | | | |
|---|---|---|---|
| 1,290,855 | 1/1919 | Wesson | 42/7 |
| 1,418,021 | 5/1922 | Reifgraber | 42/69.02 |
| 1,460,672 | 7/1923 | Hines | 42/69.02 |
| 1,693,530 | 6/1928 | Spencer | 42/69.02 |
| 1,909,425 | 4/1932 | Reid | 42/69.01 |
| 2,659,994 | 11/1953 | Yale | 42/69.02 |
| 3,188,763 | 6/1965 | Duncan | 42/69.02 |
| 4,301,609 | 11/1981 | Peterson et al. | 42/69.01 |
| 4,662,098 | 5/1987 | Timari | 42/69.01 |
| 4,691,461 | 1/1987 | Behlert | 42/69.01 |

*Primary Examiner*—Michael J. Carone

[57] ABSTRACT

A trigger for a center grip bolt action handgun with single or two stage trigger pull and adjustable sear engagement. The trigger mechanism includes a trigger to actuate a cam assembly with two adjustable contact points that progressively engage a sear release.

4 Claims, 3 Drawing Sheets

TRIGGER MECHANISM FOR FIREARMS

BACKGROUND—FIELD OF INVENTION

The field of invention is broadly firearms, and in particular triggers.

BACKGROUND—DISCUSSION OF PRIOR ART

Heretofore, bolt action pistols having the center of gravity over, or nearly over, the hand had a trigger mechanism of single stage design. A single stage trigger is more apt to be misfired. A bolt action handgun with adjustable sear engagement capable of single or two stage pull is more versatile. U.S. Pat. No. 4,301,609 to Peterson and Jennie (1981) appears to employ a trigger mechanism with drop safe features for a single shot center grip pistol. This trigger mechanism is not adaptable to a magazine fed center grip pistol and is not capable of two stage trigger pull. U.S. Pat. No. 1,693,530 to Spencer (1928) appears to employ a release bar pivotally mounted to the trigger and the holding member. This is not compatible with a two stage design trigger. U.S. Pat. No. 4,691,461 to Behlert (1987) appears to employ an adjustable pull single stage trigger mechanism comprised of a movable contact point. The results are variation in trigger pull only. A two stage trigger employing adjustable contact points allows for changes in sear engagement. U.S. Pat. No. 1,909,425 to Reid (1933) appears to employ spring and cam mechanisms to achieve a smooth follow through on trigger pull by eliminating the trigger jump. This does not apply to adjustments in sear engagement. U.S. Pat. No. 4,662,098 to Timari (1987) [preferred embodiment] includes a reference to projections on the front side of a trigger. Timari's patent lacks any suggestion that the reference could be transformed by placing the projections on the rear side of the trigger. The modification is required for use with a split trigger design such as a center grip gun and is not arbitrary. Placing the projections on the rear side of the trigger involves a new principle of operation to actuate the sear. U.S. Pat. No. 3,188,763 to Duncan (1965) shows a single stage trigger with a slit trigger design. The direction of movement is forward and is not feasible in a two stage trigger. The rail is attached to the trigger and cannot be used in a cam design which requires a floating member.

OBJECTS AND ADVANTAGES

Accordingly, the object and advantage of my invention is to provide a trigger with single or two stage trigger pull and adjustable sear engagement for center grip, or near center grip, bolt action pistols. This allows for one handgun to be adjusted to an individuals preference. Single stage triggers are suited for competitive situations. The heavy engagement of a two stage trigger provides a safety factor in hunting applications. This is accomplished by having one or both of the two stages of the trigger adjustable, changing the relative amount of engagement of the sear. Prior art U.S. Pat. No. 4,301,609 shows a pivot mounted to the action. U.S. Pat. No. 1,693,530 is a single shot pistol with a pivotally mounted single stage trigger. A means to incorporate a magazine or a two stage trigger are not within the scope of either invention. Prior art U.S. Pat. No. 4,691,461 employs a movable point of contact to change leverage advantage on a single stage trigger. This does not allow adjustment to sear engagement and is not capable of being a two stage trigger. U.S. Pat. No. 1,909,425 attempts to eliminate trigger jump by use of spring and cam mechanism. The adjustments do not affect sear engagement. U.S. Pat. No. 4,662,098 (preferred embodiment only) suggest adjustable stages on the front side of the trigger. This is not feasible in a split trigger design gun. Moving the contact points to the rear side of the trigger completely changes the mechanical function of the trigger assembly. U.S. Pat. No. 3,188,763 shows a single stage split design trigger with forward mechanical flow of movement and a rail mounted to the trigger. A two stage split design trigger requires a floating rail and a rearward flow of movement to function.

DRAWING FIGURES

REFERENCE NUMERALS IN DRAWINGS

Figure 1:
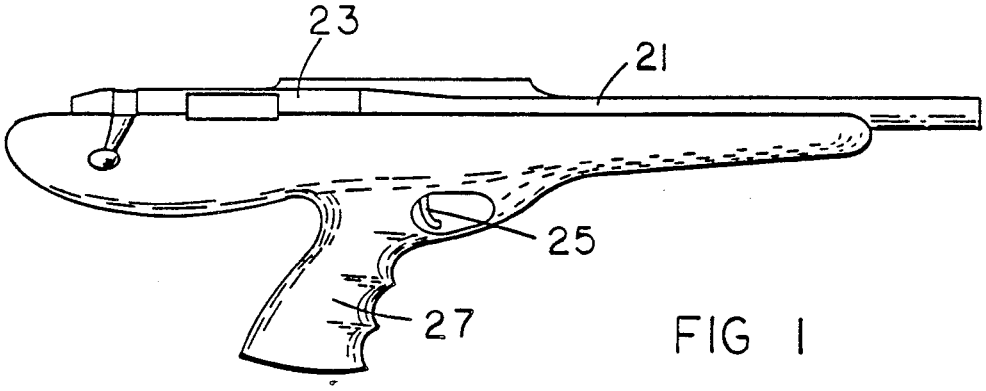
FIG. 1 is a side elevation of a bolt action pistol having a trigger mechanism employing my invention.

21 barrel
23 receiver
25 trigger
27 pistol grip
29 adjustment window
31 forward trigger housing
33 two stage cam assembly
35 assembly screws
37 recoil lug
39 sear release rail(s)
41 recoil lug
43 magazine well
45 rear trigger Plate
47 assembly screws
49 assembly screws
51 assembly screw
53 rear trigger assembly
55 side plate
57 sear release
59 sear release passage
61 dowel pin
63 dowel pin
65 cam pin
67 cam return spring
69 1st stage cam
71 2nd stage engagement screw
73 trigger mounting screw
75 over travel adjustment screw
77 cam block
79 cam block screw
81 forward trigger assembly
83 2nd stage contact point
85 over travel contact point 87 total engagement screw
89 trigger pull spring
91 trigger pull adjustment screw
93 engagement surface
95 cocking piece
97 cocking surface
99 sear
101 sear return spring

DESCRIPTION OF THE PREFERRED EMBODIMENT

FIG. 1 shows a bolt action pistol having barrel 21 projecting from bolt action receiver 23 having pistol grip 27 at the center, or near center, of balance. The trigger is designated as 25.

Figure 2:
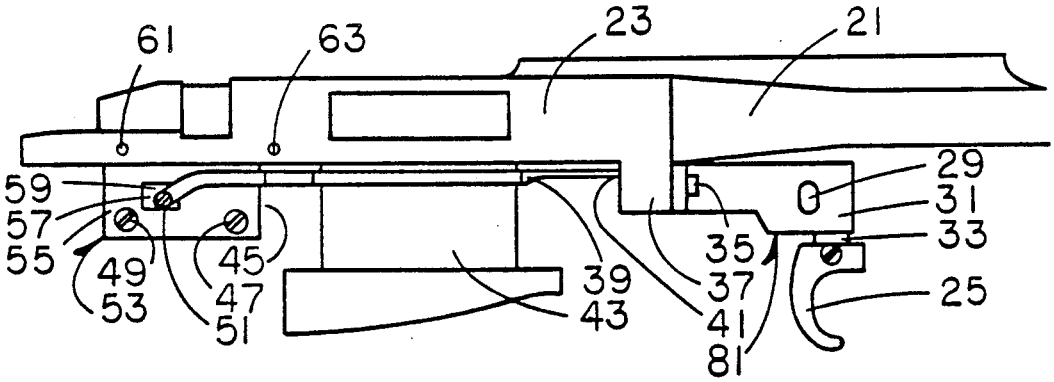
FIG. 2 is a sectional view of FIG. 1 showing one embodiment of my invention.

FIG. 2 is a sectional view of a bolt action pistol having forward trigger housing 31 with adjustment window 29 and trigger 25. Housing 31 is mounted under barrel 21 to recoil lug 37 by assembly screws 35. Sear release rails(s) 39 extend back through recoil lug passage 41 around magazine well 43 and are attached to sear release 57 by assembly screw 51. Sear release 57 rest in sear release passage 59 located in side plates 55 which are secured to rear trigger plate 45 by assembly screws 47 and 49. Dowel pins 61 and 63 lock side plates 55 to receiver 23.

Figure 3:
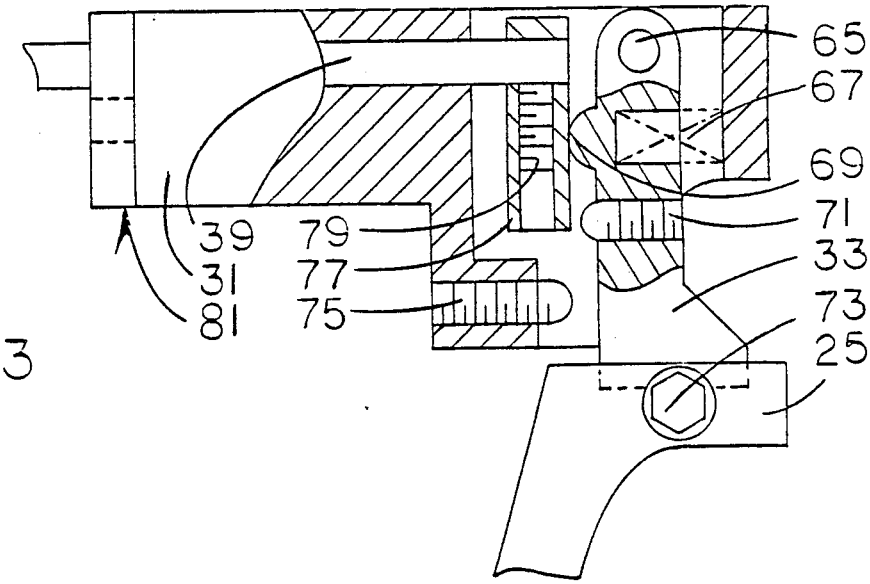
FIG. 3 is a fragmentary view, partly in section, on a larger scale, of the forward trigger assembly in a cocked position.

FIG. 3 is a fragmentary view, partly in section, of forward trigger assembly 81 in the cocked position with over travel adjustment screw 75. Two stage cam assembly 33, having cam return spring 67 and 2nd stage engagement screw 71, pivots on cam pin 65. 1st stage cam 69 is positioned against cam block 77 which is clamped to sear release rail(s) 39 by cam block screw 79. Trigger 25 is attached to cam assembly 33 by trigger mounting screw 73.

Figure 4:
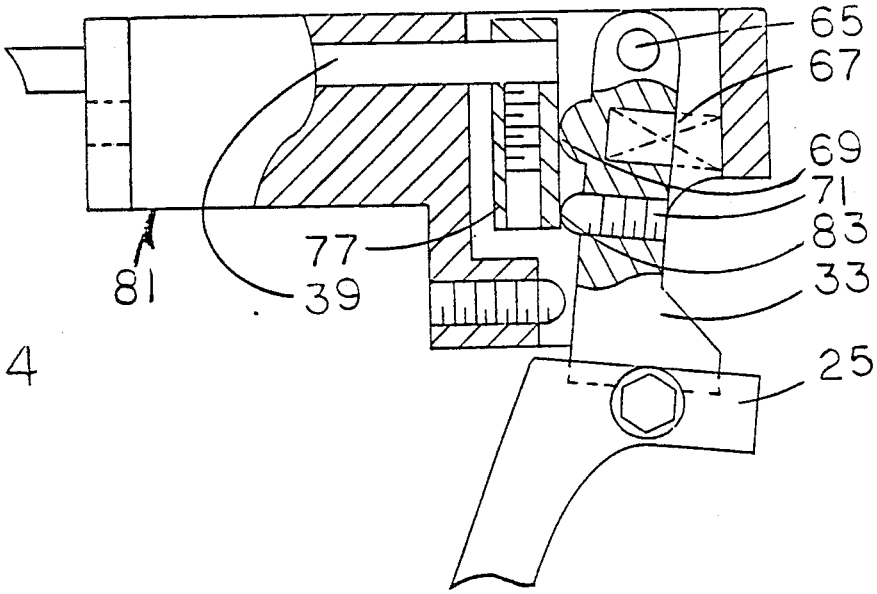
FIG. 4 is a view similar to FIG. 3 showing the 2nd stage engagement point.
Figure 5:
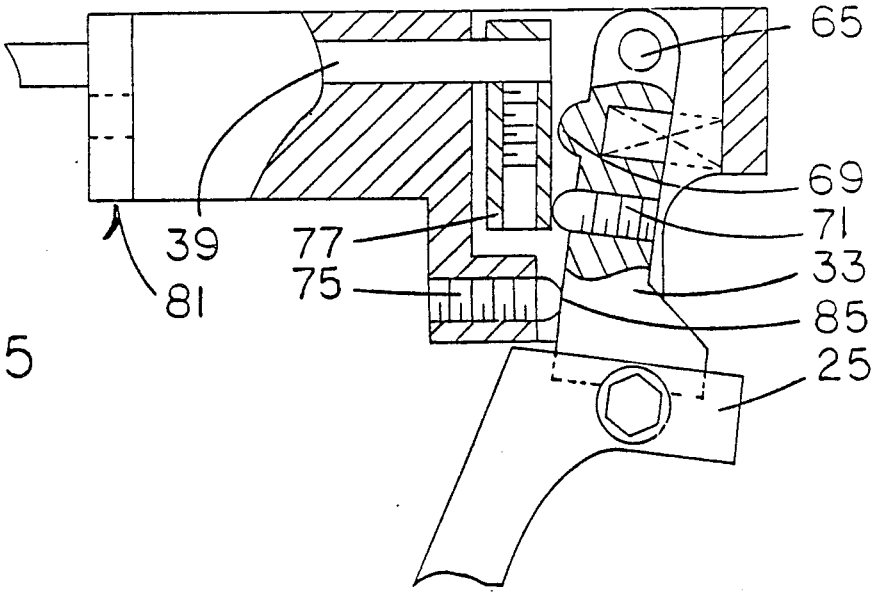
FIG. 5 is a view similar to FIG. 3 showing after fired position.

FIG. 4 and FIG. 5 show the progressive movement of the details within forward trigger assembly 81 during operation of trigger 25.

Figure 6:
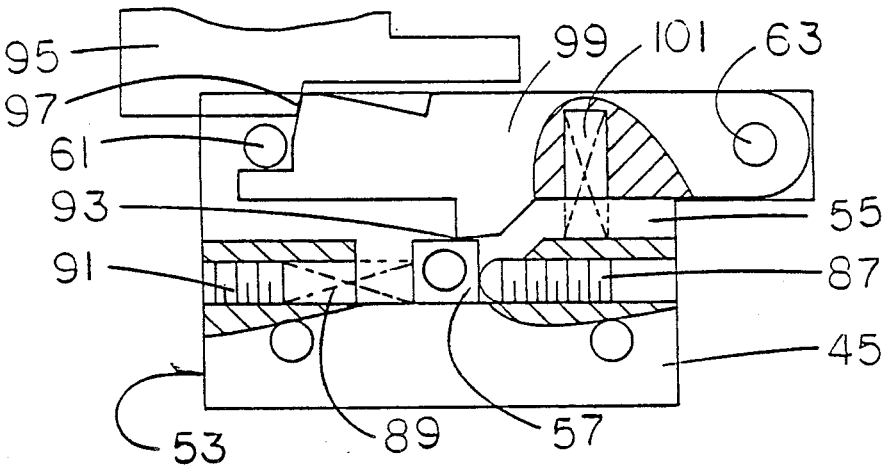
FIG. 6 is a fragmentary view, partly in section, on a larger scale, of the rear trigger assembly in a cocked position.

FIG. 6 is a fragmentary view, partly in section, of rear trigger assembly 53 in the cocked position. Sear release 57 rest on rear trigger plate 45 and is held against total engagement screw 87 by trigger pull spring 89 which is backed by trigger pull adjustment screw 91. Sear 99 rest on sear release 57 at engagement surface 93 and pivots about dowel pin 63. Sear 99 contains sear return spring 101 and engages cocking piece 95 at cocking surface 97.

Figure 7:
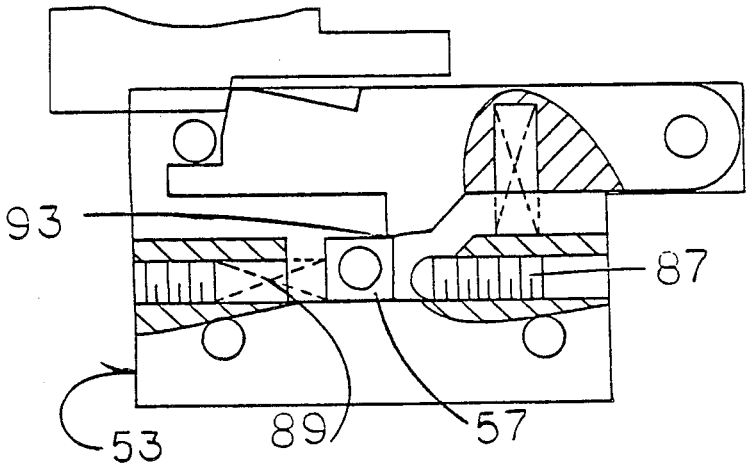
FIG. 7 is a view similar to FIG. 6 showing the rear trigger assembly in the 2nd stage engagement position.
Figure 8:
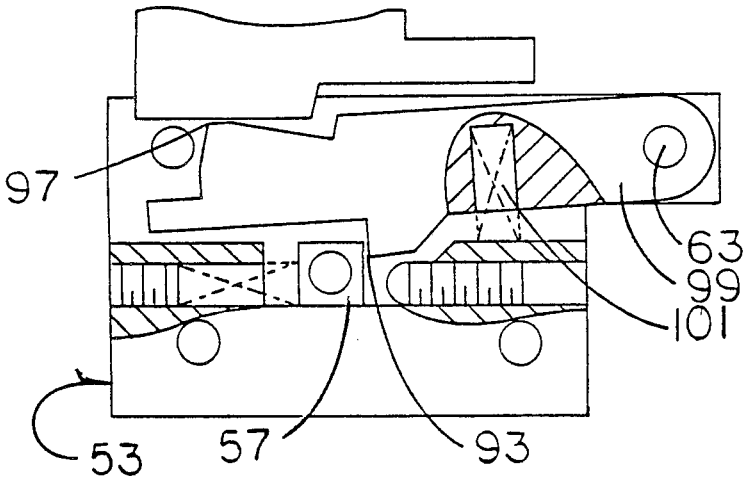
FIG. 8 is a view similar to FIG. 6 showing the rear trigger assembly in the after fired position.

FIG. 7 and FIG. 8 show the progressive movement of rear trigger assembly 53 during operation of trigger 25.

OPERATION OF THE PREFERRED EMBODIMENT

FIG. 3 and FIG. 6 show forward trigger assembly 81 and rear trigger assembly 53 in the cocked position. FIG. 4 and FIG. 7 shown forward assembly 81 and rear assembly 53 at the moment 2nd stage engagement screw 71 is engaged. FIG. 5 and FIG. 8 show forward assembly 81 and rear assembly 53 in the after fire position with trigger 25 held back against over travel adjustment screw 75.

As trigger 25 is pulled, two stage cam assembly 33 pivots about cam pin 65. 1st stage cam 69 pushes against cam block 77 moving it and sear release rail(s) 39 rearward. Screw 71 comes in contact with cam block 77 at 2nd stage contact point 83 assuming control of the rearward movement of cam block 77 and rail(s) 39. The change in the control mechanism from 1st stage cam 69 to screw 71 increases trigger pull in an abrupt and dramatic way. At this point a minimal amount of movement of trigger 25 will discharge the weapon. Trigger 25 pushes cam block 77 and rail(s) 39 rearward until movement is stopped by the contact of cam assembly 33 with screw 75 at over travel contact point 85.

Rail(s) 39 transfer rearward movement around magazine well 43 to rear assembly 53. Rail(s) 39 are secured to sear release 57 by assembly screw 51. The movement of rail(s) 39 and sear release 57 is simultaneous.

FIG. 6 shows the cocked position prior to the movement of trigger 25. Sear release 57 is resting on rear trigger plate 45 and is held up against total engagement screw 87 by trigger pull spring 89. As sear release 57 is moved rearward the amount of engagement surface 93 is decreased. The moment screw 71 assumes control of the rearward movement, surface 93 is reduced to a minimum. FIG. 7 shows a rear assembly 53 at this point. The final movement of rail(s) 39 push sear release 57 back, allowing sear 99 to pivot about dowel pin 63 until cocking piece 95 is released. FIG. 8 demonstrates the after fired position of rear assembly 53.

ADJUSTMENTS TO THE PREFERRED EMBODIMENT

Over travel adjustment screw 75 controls the amount of rearward movement of trigger 25 after release of cocking piece 95. Turning screw 75 in, decreases the amount of trigger 25 travel after the release of cocking piece 95. The advantage of being able to fine tune over travel in a trigger is the ability to stop, or nearly stop, any movement after discharge of the firearm.

Total engagement screw 87 is used to adjust the amount of engagement surface 93 which affects the total amount of trigger travel. To achieve less trigger travel, decrease the amount of surface 93 by turning screw 87 in. Conversely, backing screw 87 out lengthens surface 93 which increases trigger travel. One advantage of this adjustment is the ability to provide added safety in the field by increasing engagement. Another advantage is the ability to have a "hair" trigger for competitive shooting.

2nd stage engagement screw 71 is used to adjust the amount of engagement surface 93 used for 2nd stage travel only. Turning screw 71 in, increases the amount of 2nd stage engagement. This will decrease 1st stage engagement in a proportional amount. Conversely, backing screw 71 out will decrease 2nd stage engagement and increase 1st stage engagement. The advantage to this adjustment is the ability to change the relationship of 1st stage and 2nd stage with surface 93. This adjustment in combination with total engagement screw 87 can provide a wide range of safety and accuracy choices. The hunter, with safety being an important factor, can lengthen the 1st stage engagement and provide a reasonable 2nd stage engagement. The target sportsman, with high accuracy demands and a safer environment, can reduce 1st stage engagement to a safe minimum and reduce 2nd stage engagement to an absolute minimum. The 2nd stage engagement can be far less than the engagement in a single stage style trigger.

Trigger pull adjustment screw 91 changes the amount of trigger resistance or pull. Tightening screw 91 increases the preload of spring 89 against sear release 57. The result is heavier trigger pull. Conversely, loosening screw 91 will result in lighter trigger pull. The advantage to adjusting trigger pull is safety and accuracy demands. Heavier trigger pull is less likely to allow accidental discharge. Lighter trigger pull is needed for competitive applications.

CONCLUSION, RAMIFICATIONS, AND SCOPE OF MY INVENTION

Thus the reader will see that a trigger of the invention provides a sportsman with many new advantages over previously designed center grip bolt action pistol triggers. Trigger adjustments in pull and sear engagement allows one handgun to be used for many different types of shooting situations. Hunting applications require strict safety concerns that are addressed with heavy pull and sear engagement. Competitive situations require finely tuned triggers with options to suit each individual. This invention gives a shooter a multitude of variations in trigger settings. This trigger is capable of being used by one sportsman for many different applications. While my above description contains many specificities, these should not be construed as limitations on the scope of the invention, but rather as an exemplification of one preferred embodiment thereof. Accordingly, the scope of the invention should be determined not by the embodiment illustrated, but by the appended claims and their legal equivalents.

What is claimed is:

1. A bolt action firearm trigger mechanism comprising:

a. a trigger housing, b. a cam assembly pivotally mounted to said trigger housing, c. said cam assembly having a rear portion projecting a 1st stage contact point and a 2nd stage contact point arranged in a line from said pivot mount.

d. a firing mechanism incluidng a sear release restraining a pivotally mounted sear by an engagement surface which is progressively eliminated by said 1st stage contact point and said 2nd stage contact point during rotation of said cam assembly;

e. a means to adjust the relative projection of said 1st stage contact point and said 2nd stage contact point from said back portion of said cam assembly, thereby changing the proportion of elimination of said engagement surface preformed by said 1st stage contact point and said 2nd stage contact point.

2. A bolt action firearm trigger mechanism of claim 1 wherein said means to adjust relative projection of said 1st stage contact point and said 2nd stage contact point is one or both said points of contact comprised of a screw.

3. A bolt action firearm trigger mechanism comprising:

a. a forward trigger assembly including a trigger and a forward trigger housing, b. a cam assembly pivotally mounted to said forward trigger housing, c. said cam assembly having a rear portion projecting a 1st stage contact point and a 2nd stage contact point arranged in a line from said pivot mount, d. a rear trigger assembly having a firing mechanism, including a rear trigger plate supporting a sear release which retains a pivotally mounted sear by an engagement surface, e. a cocking piece detained by said sear, f. a rail supported by said forward trigger housing attaching to said sear release, g. actuating said trigger rotates said cam assembly rearward engaging said 1st stage contact point and said 2nd stage contact point progressively with said rail and said sear release thereby eliminating said engagement surface allowing said sear to pivot releasing said cocking piece, h. a means to adjust the relative projection of said 1st stage contact point and said 2nd stage contact point from said back portion of said cam assembly, thereby changing the proportion of elimination of said engagement surface preformed by said 1st stage contact point and said 2nd stage contact point.

4. A bolt action firearm trigger mechanism of claim 3 wherein said means to adjust relative projection of said 1st stage contact point and said 2nd stage contact point is one or both said points of contact being comprised of a screw.

* * * * *